US006234312B1

(12) United States Patent
Davis, Sr.

(10) Patent No.: US 6,234,312 B1
(45) Date of Patent: May 22, 2001

(54) GOLF BAG COVER AND METHOD FOR PREVENTING THEFT OF GOLF CLUBS

(76) Inventor: Tyrone Lloyd Davis, Sr., 2734 Oakman Blvd., Detroit, MI (US) 48238

( * ) Notice: Subject to any disclaimer, the term of this patent is extended or adjusted under 35 U.S.C. 154(b) by 0 days.

(21) Appl. No.: 09/121,297

(22) Filed: Jul. 23, 1998

(51) Int. Cl.[7] ..... A63B 57/00
(52) U.S. Cl. ..... 206/527; 206/315.4; 150/159
(58) Field of Search ..... 150/159, 160, 150/154; 190/101; 206/315.2–315.4, 527

(56) References Cited

U.S. PATENT DOCUMENTS

| | | | | |
|---|---|---|---|---|
| 1,119,508 | * | 12/1914 | Headley | 206/315.4 |
| 1,149,028 | * | 8/1915 | Chapman | 206/315.4 X |
| 1,557,433 | | 10/1925 | Delamater . | |
| 1,570,510 | * | 1/1926 | McQuirk | 206/315.4 |
| 1,908,998 | | 5/1933 | Mullins . | |
| 2,035,529 | * | 3/1936 | Bucklin | 150/160 |
| 2,751,955 | * | 6/1956 | Nahon | 206/315.4 X |
| 4,512,465 | * | 4/1985 | Jobe | 206/315.4 |
| 4,792,026 | * | 12/1988 | Dimmick et al. | 190/101 |
| 4,907,728 | * | 3/1990 | Giblet | 190/18 A X |
| 5,226,464 | * | 7/1993 | Solov | 150/159 |
| 5,507,332 | * | 4/1996 | McKinnon | 150/159 |
| 5,560,485 | | 10/1996 | O'Hara, Jr. | 206/315.4 |
| 5,582,043 | | 12/1996 | McCue | 70/58 |
| 5,904,247 | * | 5/1999 | Voelkner, Jr. | 150/159 X |

FOREIGN PATENT DOCUMENTS

| | | | | |
|---|---|---|---|---|
| 6126 | * | 12/1911 | (GB) | 206/315.3 |
| 714316 | * | 8/1954 | (GB) | 206/315.3 |
| 2254007 | * | 9/1992 | (GB) | 150/159 |
| 9105492 | * | 5/1991 | (WO) | 190/101 |

* cited by examiner

*Primary Examiner*—Sue A. Weaver
(74) *Attorney, Agent, or Firm*—Goldstein & Canino

(57) ABSTRACT

A golf bag cover for use with a golf bag for preventing theft of golf clubs retained therein, and method for preventing the theft of the clubs, comprising a covering piece having an inner layer constructed of cables welded together to form a hood-like shape and an outer layer stitched over the inner layer to keep the clubs dry. A plurality of cables from the inner layer extend downward and terminate in a plurality of loops. A belt is inserted through the loops of the covering piece and placed tightly around the upper periphery of the golf bag to prevent removal of the covering piece therefrom. The covering piece is provided with a zipper which opens and closes to allow access to the clubs. To prevent unauthorized opening of the zipper, a first padlock is inserted through the belt buckle and the eye of the zipper. A cable strap and a second padlock are used to secure the golf bag to a fixed structure.

6 Claims, 3 Drawing Sheets

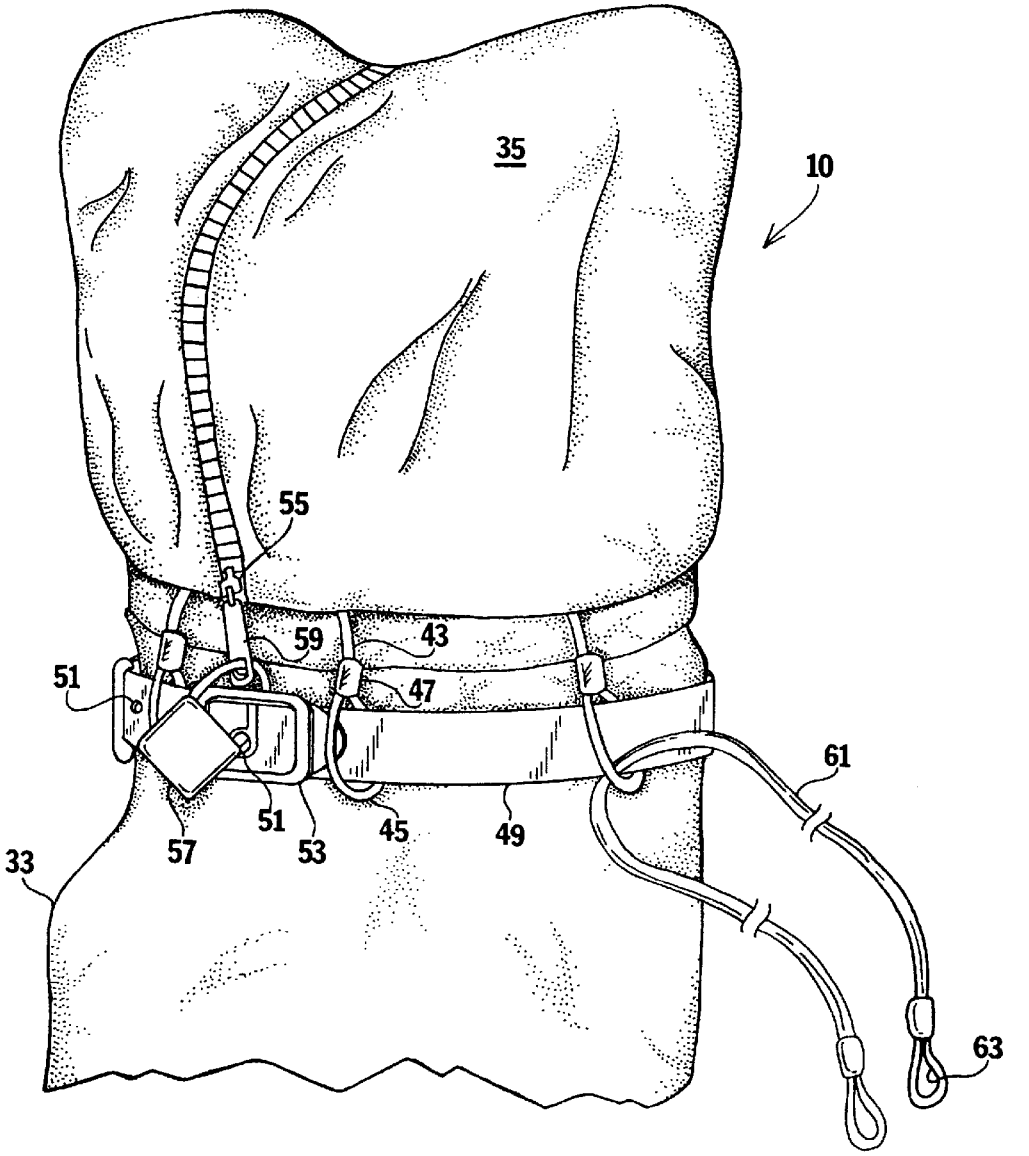
FIG.1
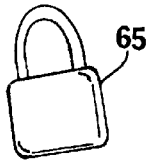

GOLF BAG COVER AND METHOD FOR PREVENTING THEFT OF GOLF CLUBS

BACKGROUND OF THE INVENTION

This invention relates to a golf bag cover. More particularly, the invention relates to a golf bag cover for securing a golf bag and clubs retained therein against theft.

Golf has become one of the most popular individual sports engaged in by people of all ages. Most golf courses are provided with clubhouses and use of such facilities commonly requires golfers to leave their golf bags outside the facility. Consequently, golfers are often forced to leave their golf bags unattended with the golf clubs exposed while inside the clubhouse. Due to their portability and high cost, golf clubs are highly susceptible to theft. Thus, it is desirable to have a device that can protect the clubs against theft while they are left unattended.

Accordingly, in an attempt to discourage theft of golf equipment, several references uncovered in the prior art describe various devices for securing the contents of a golf bag. For example, U.S. Pat. No. 5,582,043 to McCue discloses a golf bag and club securing device in which a cover is placed over the top of the golf clubs in the golf bag and connected to the clip member to prevent removal of the cover, so as to keep the golf clubs within the golf bag and stop the theft of the golf clubs. However, McCue suffers from various disadvantages in that the club securing cover must be completely removed from the golf bag in order to access the clubs retained therein. Varieties of other prior art devices are disclosed in U.S. Pat. Nos. 5,560,485, 1,908,998, and 1,557,433.

While these units mentioned above may be suitable for the particular purpose employed, or for general use, they would not be as suitable for the purposes of the present invention as disclosed hereafter.

SUMMARY OF THE INVENTION

It is an object of the invention to provide a golf bag cover which is simple in construction so as to minimize manufacturing cost and yet is capable of preventing the golf bag and its contents from being stolen.

It is another object of the invention to provide a golf bag cover which permits easy access to the golf clubs retained within the golf bag without having the remove the cover therefrom.

It is yet another object of the invention to provide a golf bag cover which can be readily used with existing golf bags.

It is a further object of the invention to provide a covering piece which has a sufficiently durable construction so as to prevent the covering piece from being torn apart by a thief attempting to gain access to the bag, at least to an extent that would permit passage of a golf club inside the bag.

The invention is a golf bag cover for use with a golf bag for preventing theft of golf clubs retained therein, comprising a covering piece having an inner layer constructed of cables welded together to form a hood-like shape and an outer layer stitched over the inner layer to keep the clubs dry. A plurality of cables from the inner layer extend downward and terminate in a plurality of loops. A belt is inserted through the loops of the covering piece and placed tightly around the upper periphery of the golf bag to prevent removal of the covering piece therefrom. The covering piece is provided with a zipper which opens and closes to allow access to the clubs. To prevent unauthorized opening of the zipper, a first padlock is inserted through the belt buckle and the eye of the zipper. A cable strap and a second padlock are used to secure the golf bag to a fixed structure.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view of a preferred embodiment of a golf bag cover in accordance with the principles of the present invention.

DETAILED DESCRIPTION OF THE PREFERRED EMBODIMENTS

FIG. 1 illustrates a preferred embodiment of a golf bag cover 10 in accordance with the principles of the present invention. As will be seen in the following paragraphs, the golf bag cover 10 of the present invention is designed securing a golf bag and its contents against theft. For better understanding of the present invention, a conventional golf bag 33 is illustrating having a body and an opening at its top for receiving golf clubs.

Figure 2:
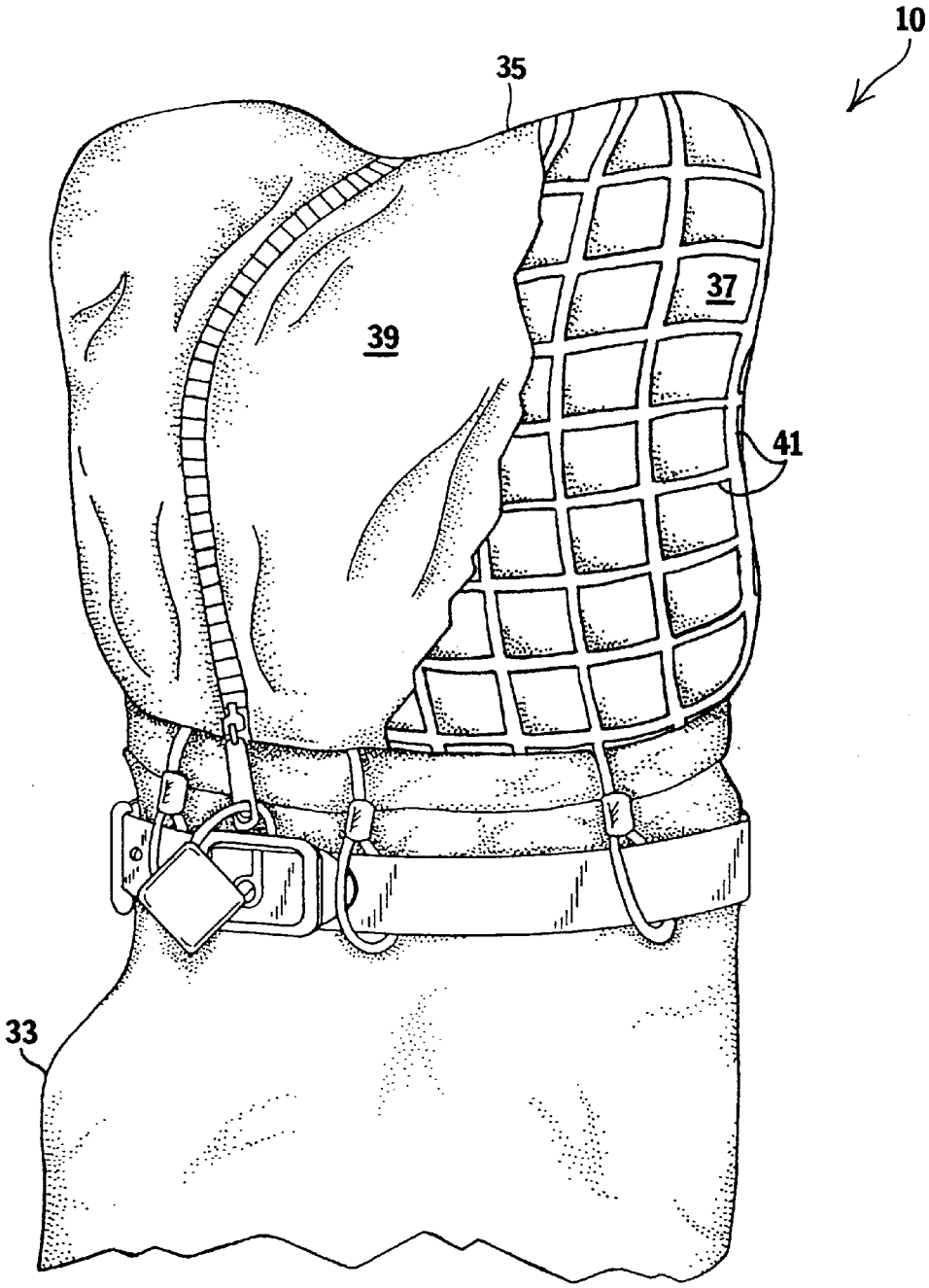
FIG. 2 is a diagrammatic perspective view of a covering piece of the present invention, with parts of the outer layer broken away, illustrating the inner layer thereof constructed of metal cables welded together to form a hood-like shape.

As seen by referring to FIG. 2, a preferred embodiment of the present invention utilizes a covering piece 35 having an inner layer 37 constructed of cables 41 welded together to form a hood-like shape. The covering piece 35 is provided with a base opening adapted to fit over the top opening of the golf bag 33 so as to cover the golf clubs projecting therefrom. In this way, the inner layer 37 is sufficiently durable to prevent the covering piece 35 from being torn apart by a thief attempting to gain access, at least to an extent that would permit passage of the golf clubs. Although in the preferred embodiment, the inner layer 37 is constructed of metal cables 41 to strengthen the covering piece 35, it should be noted that the inner layer 41 can be constructed of any other durable material capable of resisting an unauthorized attempt to gain access to the clubs contained therein. The covering piece 35 further comprises an outer layer 39 stitched over the inner layer 37 to keep the clubs dry during inclement weather, which can be made from any suitable fabric material, including vinyl, canvas, and leather.

Referring back to FIG. 1, a plurality of cables 43 from the inner layer 37 extend downward in uniform spaced relation from the lower periphery of the covering piece 35, terminating in loops 45. Each of the loops 45 are formed by doubling the cable 43 on itself and wrapping a metal clamp 47 around the loop 45 to permanently retain the cable in its looped condition. The golf bag cover 10 of the present invention also includes a belt 49 to be inserted through the loops 45 and placed tightly around the upper periphery of the golf bag 33 for preventing removal of the covering piece therefrom. The belt 49 has adjustable holes 51 so as to fit golf bags having different sizes and belt buckle 53 having a fastening member pivotally secured thereto for engaging the adjustable holes 51. The belt 49 is preferably constructed of strong, durable material which will resist cutting, such a mesh metal arrangement.

The covering piece 35 is provided with a zipper 55, which open and close to allow easy access to the golf clubs retained within the golf bag 33. To prevent unauthorized opening of the zipper 55, a first padlock 57 is inserted through the belt buckle 53, through one of the adjustable holes 51 in the belt 49, and through the eye formed within the zipper pull-tab 59. A cable strap 61 is employed to anchor the golf bag 33 to a suitable fixed structure found in golf courses, such as a golf rack, pole, tree, and the like. The cable strap 61 is preferably of type which can resist cutting, such as an aircraft cable. Each end of the cable strap 61 includes an eye 63 for receiving a second padlock 65.

Figure 3:
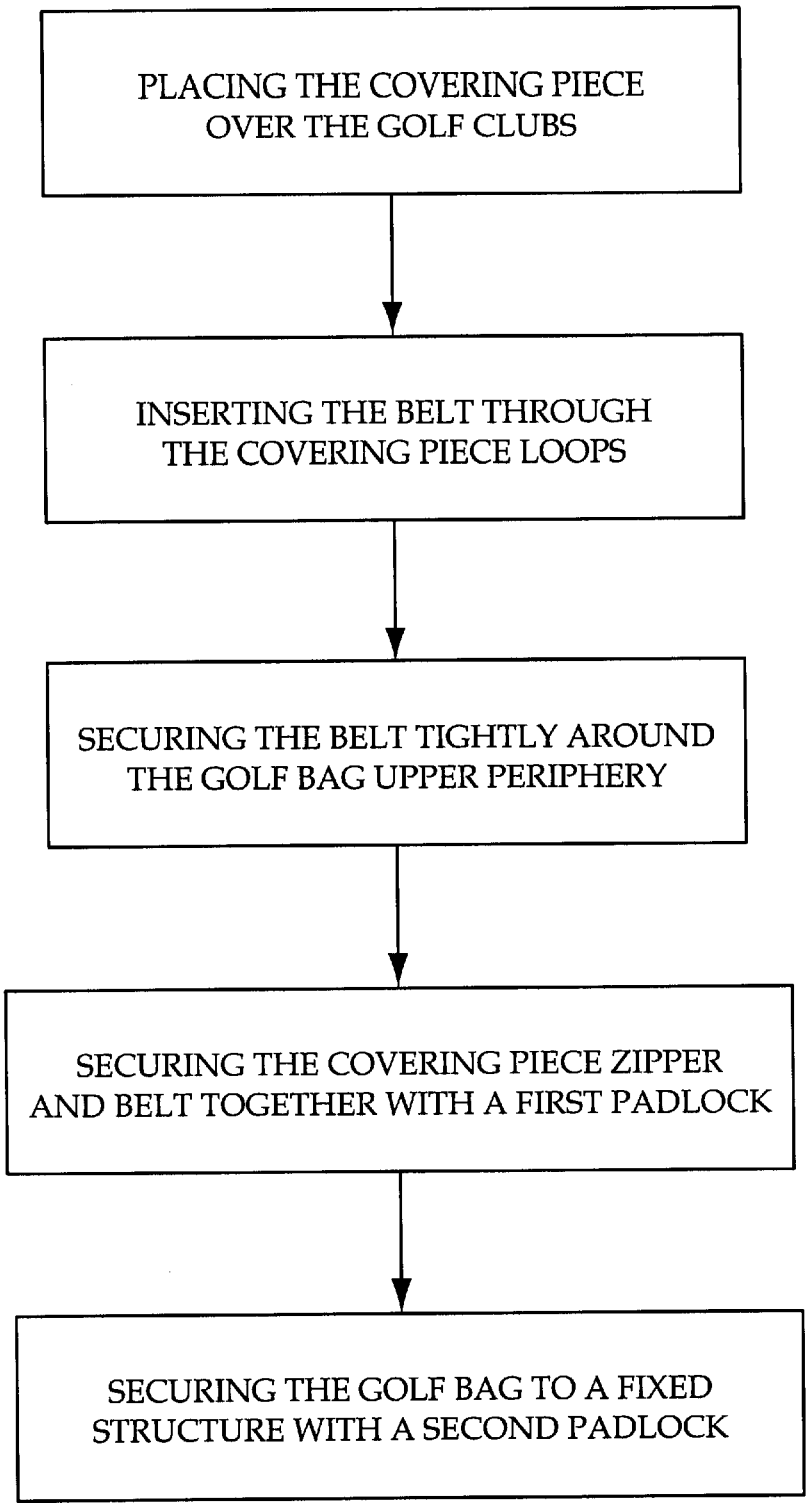
FIG. 3 is a flow chart describing steps involved in using the present invention.

The operation of the golf bag cover 10 will now be described. To prevent a thief from accessing a set of golf clubs inside a golf bag, the covering piece 35 is pulled over the top ends of the clubs. Whereupon, the belt 49 is inserted through the loops 45 extending from the covering piece 35 and firmly fastened about the upper periphery of the golf bag 33. The zipper 55 on the covering piece is pulled down and the first padlock 57 is used to secure the zipper to the belt to prevent removal of the covering piece from the golf bag. The cable strap 61 is passed through one or more of the loops extending downward from the covering piece, through the golf bag handle, and wrapped about a fixed structure. The cable strap 61 may be locked together by a second padlock 65 to prevent the golf bag from being stolen. FIG. 3 reiterates the major steps involved in using the golf bag cover 10.

Many specific details contained in the above description merely illustrate some preferred embodiments and should not be construed as a limitation on the scope of the invention. Many other variations are possible.

What is claimed is:

1. A golf bag cover for use with a golf bag for preventing theft of golf clubs retained therein, said golf bag having an open end, comprising:

a) a covering piece having an base opening for receiving the open end of the golf bag and a plurality of loops extending downward from its base, said covering piece having sufficiently durable construction so as to prevent from being torn apart by a thief attempting to gain access to the golf clubs, said covering piece provided with a zipper which open and close to allow access to the golf clubs retained in the golf bag;

b) a pliable fastening means adapted to be inserted through said loops and secured tightly around upper periphery of the golf bag for preventing removal of the covering piece therefrom;

c) first locking means for securing the zipper and said fastening means together to prevent unauthorized opening of the zipper; and d) second locking means for securing said golf bag to a fixed structure to prevent the golf bag from being stolen.

2. The golf bag cover as recited in claim 1, wherein the covering piece comprising an inner layer constructed of cables welded together to form a hood-like shape, and an outer layer covering said inner layer to keep the clubs dry during inclement weather.

3. The golf bag cover as recited in claim 2, wherein the fastening means comprises a belt having adjustable holes and belt buckle having a fastening member pivotally secured thereto for engaging the adjustable holes.

4. The golf bag cover as recited in claim 3, wherein the belt is constructed of flexible mesh metal arrangement.

5. The golf bag cover as recited in claim 1, wherein the second locking means comprises a padlock, and a cable strap having an eye at each ends for receiving said padlock.

6. A method of preventing theft of golf clubs retained inside a golf bag, with a covering piece having a zipper and a plurality of loops extending downward therefrom, said method comprising steps of:

a) placing said covering piece over the golf clubs projecting from the golf bag;

b) inserting a belt through said loops extend downward from the covering piece;

c) securing said belt tightly about upper periphery of the golf bag, the belt having a belt buckle;

d) securing the zipper on the covering piece and the belt buckle together with a first padlock to prevent unauthorized removal of the covering piece from the golf bag; and e) securing the golf bag to a fixed structure using a cable and a second padlock.

* * * * *